US005836836A

United States Patent [19]

Grimes

[11] Patent Number: 5,836,836

[45] Date of Patent: Nov. 17, 1998

[54] TETHERED BALL BATTING PRACTICE MACHINE

[76] Inventor: George Grimes, 213 Summerset, Bentonville, Ark. 72712

[21] Appl. No.: 790,052

[22] Filed: Jan. 28, 1997

[51] Int. Cl.[6] ..... A63B 69/38

[52] U.S. Cl. ..... 473/427

[58] Field of Search ..... 473/428, 429, 473/430, 427

[56] References Cited

U.S. PATENT DOCUMENTS

| | | | |
|---|---|---|---|
| 2,637,208 | 1/1953 | Allred | 473/429 |
| 3,762,705 | 10/1973 | Gonzalez . | |
| 3,885,790 | 5/1975 | Parr | 473/429 |
| 3,897,057 | 7/1975 | Pennington . | |
| 4,872,675 | 10/1989 | Crowden . | |
| 5,018,729 | 5/1991 | Wilkerson . | |
| 5,184,816 | 2/1993 | Lunsford . | |
| 5,275,396 | 1/1994 | Sudia . | |
| 5,454,561 | 10/1995 | Smith . | |
| 5,458,326 | 10/1995 | Marcyes . | |

*Primary Examiner*—Theatrice Brown
*Attorney, Agent, or Firm*—Head, Johnson & Kachigian

[57] ABSTRACT

The invention relates to an improved batting machine which presents a batter with a ball which is swung around in a generally circular path. The invention was designed to swing the ball in either a horizontal path or a path which is offset from horizontal. The ball is connected to an extended arm via a tether. The extended arm is also connected to a vertical shaft. The shaft is rotated by an electric motor means, along with a centrifugal clutch. The motor is able to rotate the shaft in either clockwise or counterclockwise direction, thus giving the batter the opportunity to bat right and/or left handed. The shaft motor assembly is supported by a plurality of adjustable supports.

5 Claims, 1 Drawing Sheet

TETHERED BALL BATTING PRACTICE MACHINE

TECHNICAL FIELD

This invention relates generally to a device for training and practicing hitting a moving baseball or softball. More specifically, the invention relates to a portable batting practice machine which simulates a ball which has been thrown by a person. The present invention in particular allows a user to be exposed to repetitive simulated pitches.

BACKGROUND OF INVENTION

The participants in baseball or softball, fast pitch or slow pitch, must all have the hand-eye coordination required to strike a moving ball. Participants, therefore, must practice at great length to develop these skills. Because of the nature of the sport, batting practice machines have been developed in order to give the participants more practice at developing these skills in the shortest amount of time. These machines include manual or automated pitching machines wherein balls are loaded into the machine which are then hurled toward the participants in an effort to simulate the pitching of the ball. These devices are useful in that they do away with the requirement of having an actual pitcher throwing the ball toward the participant. These devices however have a disadvantage in that they require an adequate supply of balls as well as require another person to retrieve those balls which were hit.

In order to overcome the disadvantages of the pitching machines, other devices have been developed which allow a participant to practice batting by him or herself. For example, Sudia in U.S. Pat. No. 5,275,396, discloses a portable batting practice machine having a DC drive motor operably connected to a horizontal arm for rotation in a forward direction. Sensors are provided for detecting when the shaft is rotated in the opposite direction and for measuring the speed of the shaft and a speech processor cooperates with the sensors for providing immediate audio feed back to the user. The Sudia batting practice machine allows the motor to be forcibly driven in a reverse direction when the ball is struck sharply in the opposite direction to that driven by the motor. The DC motor tends to resist motion in the reverse direction, and when the motor overcomes this motion, it resumes driving the ball in the forward direction.

In Crowden, U.S. Pat. No. 4,872,675, the claimed invention discloses a baseball pitching device designed to swing a tethered baseball in a substantially horizontal path by a variable speed motor and a V belt arrangement. The tension of the belt is adjusted to allow the belt to slip when counter rotational force is placed upon the rotating drive shaft due to the batting or hitting of the ball.

In Pennington, U.S. Pat. No. 3,897,057, the claimed device discloses a tethered baseball practice device, including a cord attached to a tubular boom with a cord including a swivel snap means to provide for replacement of the ball and a short ball cord.

However, such devices including Sudia and Crowden have numerous disadvantages. Most device are mechanically complex, thus expensive to manufacture and difficult for a single person to set up. Furthermore, these devices do not allow for a person to adjust the height of their particular batting machine nor are they designed to withstand the different types of forces placed upon them during use.

The current invention discloses an improved batting machine which by means of adjustable legs allows the user to adjust its height as well as by the use of a standard clutch assembly be able to absorb the different types of forces which will be placed upon it, without damaging the motor driving the machine.

BRIEF SUMMARY OF THE INVENTION

The preferred embodiment of this invention includes a portable support frame which has a plurality of expandable legs to supply necessary support. A movable arm is mounted to the frame. A tethered ball is attached to one end of the arm by means of a securing device. The arm is mounted to a drive shaft. The drive shaft is coupled with a clutch assembly and an electric motor the clutch assembly can be either a centrifugal clutch, centrifugal fluid driven clutch, or a centrifugal fluid driven clutch having of a plurality of vertically oriented turbine blades therein. When the motor is activated, the drive shaft is driven in either clockwise or counterclockwise direction. The expandable legs are independent of each other. This allows the frame to be tilted, simulating a dropping type of pitch.

BRIEF DESCRIPTION OF THE DRAWINGS

The invention is illustrated more or less in the accompanied drawing wherein.

DETAILED DESCRIPTION OF THE PREFERRED EMBODIMENT

Figure 1:
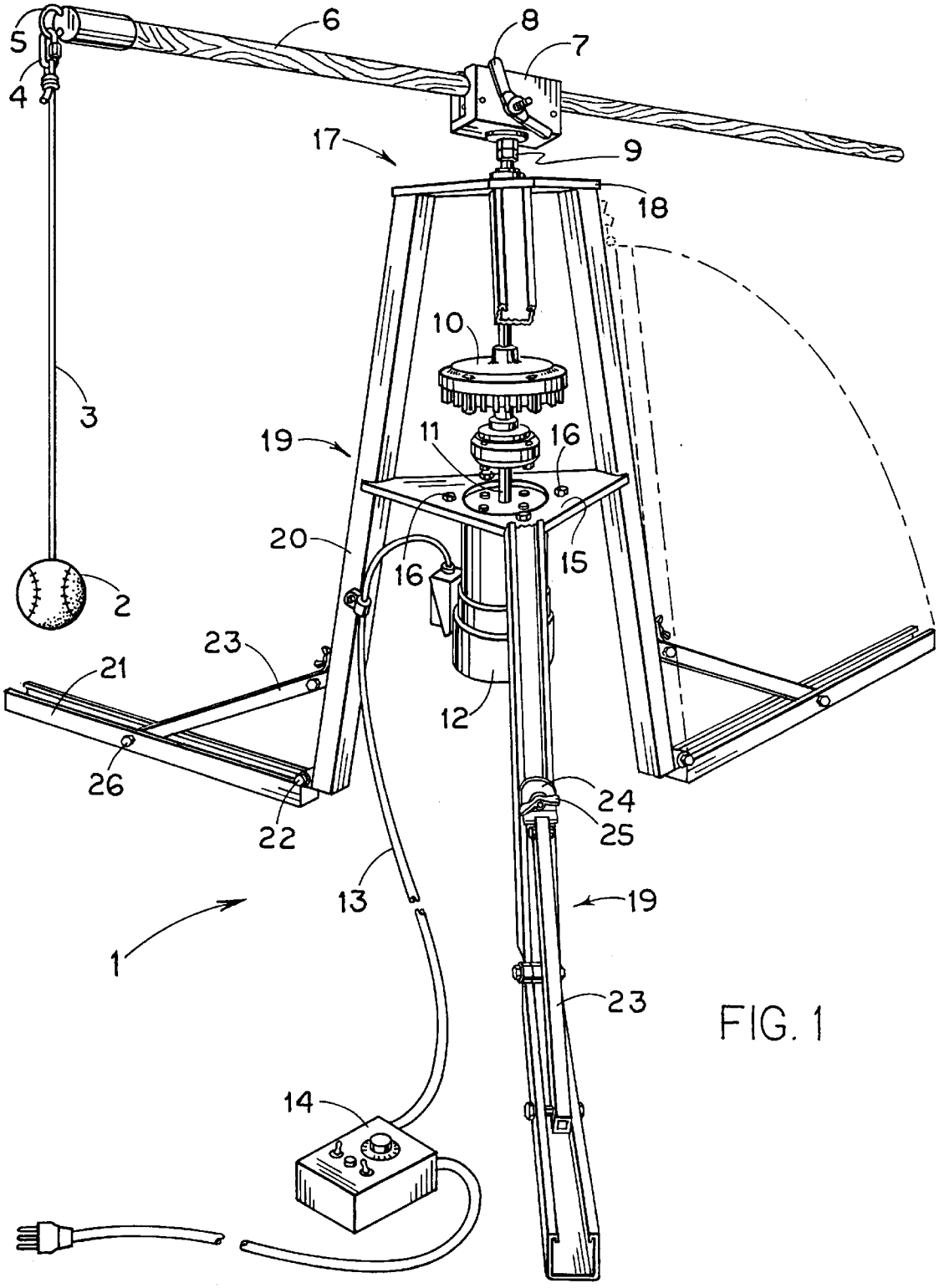
FIG. 1 is a perspective view.

As shown in FIG. 1, a portable light weight batting practice apparatus is generally shown as 1. The apparatus swings a ball 2.

A base means 17 is provided and utilizes three legs 19 each legs consist of two members, upper leg 20 and lower leg 21, with lower leg 21 being able to fold outward away from upper leg 20 by pivot means 20. The member 19*b* when extended can be used to stabilize the apparatus 1. Furthermore, the angle created between upper leg 20 and lower leg 21 can be greater than 90 degrees and is independent from the other legs. This independence causes the apparatus 1 to be able to be adjusted so that the pitch of the ball 2 can be set to the user's preference, such as simulating a dropping motion.

The angle between upper leg 20 and lower leg 21 is controlled by a slide 24 which is placed within upper leg 20 and is connected to one end of bar 23 with the other end of bar 23 connected to lower leg 21. Slide 24 is connected to bar 23 by a connection means 25. Bar 23 is connected by pivot means 26 to lower leg 21.

An electrical motor 12 is secured by a plurality of securing means to plate 15, with plate 15 being part of base 17. Electrical motor 12 being a cylindrical type motor with one end having a drive shaft 11 protruding vertically from it. This end is the same end connected to plate 15. The electrical motor 12 has a power cord 13, which is connected to a remote control mechanism 14. The remote control 14 allows the operator to vary the power and the direction to the electrical motor 12, thus adjusting the rotational speed of shaft 11.

Shaft 11 is connected to clutch 10. Clutch 10 absorbs the force acted upon ball 2, thus preventing damage to electrical motor 12. This allows for an increase in the use of apparatus 1.

Clutch 10 consist of a standard automobile-type fan clutch assembly.

Shaft 9 having one end connected to clutch 10 passing through plate 18, which is part of base 17, with the other end connected to clamp means 7.

Ball 2 is connected to one end of a cord means 3 with the other end of cord means 3 connected to securing means 4. Securing means 4 is connected to boom 6 by a connection means 5. Boom 6 is connected to clamp means 7, by a securing means 8. By these connections, when electrical motor means 12 rotates shaft 11, shaft 9 by means of clutch 10 also rotates with the same power and direction as shaft 11, which in turn rotates clamp means 7, thus rotates boom 6 and swings ball 2 in a rotational direction.

REFERENCE NUMERALS AS INDICATED

| | |
|---|---|
| 1. Batting Practice Machine | 14. Control Mechanism |
| 2. Ball | 15. Plate |
| 3. Power Cord | 16. Securing Means |
| 4. Securing Means | 17. Base Means |
| 5. Connection Means | 18. Plate |
| 6. Boom | 19. Leg Means |
| 7. Clamp | 20. Upper Leg |
| 8. Securing Means | 21. Lower Leg |
| 9. Shaft | 22. Pivot Means |
| 10. Clutch Assembly | 23. Bar |
| 11. Shaft | 24. Slide |
| 12. Motor | 25. Connection Means |
| 13. Power Cord | 26. Pivot Means |

What is claimed to be new and desired to be protected by Letters Patent of the United States is as follows:

1. An improved batting practice device comprising:

a frame having a plurality of foldable support legs providing stabilization to said frame, said support legs being in a substantially tripod configuration; each of said legs being substantially L-shaped and having a substantially vertical section and a horizontal base section when said device is in use; said base section having one end thereof pivotally attached to the lower end of said vertical section; brace means extending between said vertical and horizontal sections, and having one end thereof attached intermediate the ends of one of said vertical and horizontal sections and its other end releasably attached intermediate the ends of one of said vertical and horizontal sections, whereby said frame can be folded to a compact configuration when not in use;

a laterally extended rotateable arm member supported by said frame, a tethered ball connected to one end of said arm member, and a driving apparatus supported by said frame and connected to said arm member and used for rotating said arm member about said frame.

2. The device of claim 1 wherein said driving apparatus further comprises:

a variable speed motor, a centrifugal clutch, a first drive shaft having a first end and a second end with the first end in connection with said motor and the second end in connection with said clutch and when energized is free to rotate in a clockwise or counterclockwise direction relative to said motor, and a second drive shaft having a third end and fourth end with the third end in connection with said arm member and the fourth end in connection with said clutch and when energized is free to rotate in a clockwise or counterclockwise direction relative to said clutch.

3. The device of claim 2 wherein the variable speed motor is reversible.

4. An improved batting practice device comprising:

a frame having a plurality of foldable support legs providing stabilization to said frame;

a laterally extended rotateable arm member supported by said frame, a tethered ball connected to one end of said arm member, and a driving apparatus supported by said frame and connected to said arm member and used for rotating said arm member about said frame, wherein said driving apparatus further comprises a variable speed motor, a centrifugal clutch, a first drive shaft having a first end and a second end with the first end in connection with said motor and the second end in connection with said clutch and when energized is free to rotate in a clockwise or counterclockwise direction relative to said motor, and a second drive shaft having a third end and fourth end with the third end in connection with said arm member and the fourth end in connection with said clutch and when energized is free to rotate in a clockwise or counterclockwise direction relative to said clutch.

5. The device of claim 4 wherein the variable speed motor is reversible.

* * * * *